US010118432B2

(12) United States Patent
Pfahler

(10) Patent No.: US 10,118,432 B2
(45) Date of Patent: Nov. 6, 2018

(54) NOTEBOOK SQUARING APPARATUS

(71) Applicant: Jolie Pfahler, Calabasas, CA (US)

(72) Inventor: Jolie Pfahler, Calabasas, CA (US)

(73) Assignee: Jolie Pfahler, Calabasas, CA (US)

( * ) Notice: Subject to any disclaimer, the term of this patent is extended or adjusted under 35 U.S.C. 154(b) by 0 days.

(21) Appl. No.: 15/724,536

(22) Filed: Oct. 4, 2017

(65) Prior Publication Data

US 2018/0099522 A1 Apr. 12, 2018

Related U.S. Application Data

(60) Provisional application No. 62/405,385, filed on Oct. 7, 2016.

(51) Int. Cl.
*B42F 13/00* (2006.01)
*B42F 13/40* (2006.01)
*B42F 13/22* (2006.01)

(52) U.S. Cl.
CPC ..... *B42F 13/402* (2013.01); *B42F 13/004* (2013.01); *B42F 13/0006* (2013.01); *B42F 13/0026* (2013.01); *B42F 13/22* (2013.01); *B42P 2241/12* (2013.01)

(58) Field of Classification Search
CPC ... B42F 13/006; B42F 13/004; B42F 13/0026
USPC ..... 402/73–78, 80 R; 281/20
See application file for complete search history.

(56) References Cited

U.S. PATENT DOCUMENTS

| | | | | |
|---|---|---|---|---|
| 2,732,842 | A * | 1/1956 | Loudon | B42F 13/0026 402/74 |
| 4,531,764 | A * | 7/1985 | Chang | B42F 13/40 402/80 R |
| 4,744,689 | A * | 5/1988 | Sternberg | B42D 3/10 402/73 |
| 4,997,207 | A * | 3/1991 | Feldman | B42F 13/0006 402/73 |
| 5,108,130 | A | 4/1992 | Hansen | |
| 5,267,804 | A | 12/1993 | Baumgarten | |
| 5,540,462 | A | 7/1996 | Laursdahl et al. | |
| 5,562,309 | A * | 10/1996 | Brink | B42D 1/10 281/21.1 |
| 5,634,666 | A | 6/1997 | Lee | |
| 5,897,141 | A * | 4/1999 | Dugmore | B42F 13/004 281/28 |
| 5,947,521 | A | 9/1999 | Stucki | |
| 6,467,808 | B1 * | 10/2002 | Kirby | B42D 3/126 116/239 |
| D639,336 | S * | 6/2011 | Houmes | D19/32 |
| 9,057,476 | B2 | 6/2015 | Sweere et al. | |
| 2007/0231058 | A1 * | 10/2007 | Vincent | B42F 13/16 402/74 |

* cited by examiner

*Primary Examiner* — Kyle R Grabowski

(57) ABSTRACT

An apparatus for selectively bracing and squaring opposite covers of a notebook includes a portion associated with an inner surface of one notebook cover and a connector associated with an inner surface of an opposite cover. When the connector and unfolded brace are attached to one another, the notebook is held in a generally square configuration wherein the opposing covers are disposed generally parallel to one another.

10 Claims, 9 Drawing Sheets

NOTEBOOK SQUARING APPARATUS

RELATED APPLICATION

This application claims priority to U.S. Provisional Application Ser. No. 62/405,385, filed Oct. 7, 2016.

BACKGROUND OF THE INVENTION

The present invention generally relates to notebooks, including ringed binders. More particularly, the present invention relates to an apparatus for squaring or bracing the open end of such notebooks and binders so that they stay upright when placed on a shelf and properly stacked when at less than capacity or empty.

Notebooks and ringed binders are commonly used to hold documents and other papers. Typically, notebooks and binders are configured so as to removably hold such papers and are offered in various sizes which typically refer to the width of the spine or rings, such as being between ½" to several inches in diameter. The larger the diameter or size, the greater the number of papers and documents which may be held therein.

The notebooks include means for removably holding the papers therein. In the case of a ringed binder, multiple circular or D-shaped retainers, usually called rings, serve to removably hold papers which have been hole-punched. In the United States, the 3-ring binder is particularly popular, although there may be as few as two rings and more than three rings to retain or hold the papers. The rings are usually spring-loaded and include a mechanism for opening and closing the rings to permit papers to be added or removed and closed for retention within the notebook or binder.

Generally opposite panels or covers are pivotally connected to the spine. Typically, this is by means of a living hinge, wherein each cover can be pivoted away from the other cover so as to open the notebook or binder, and brought towards one another in order to close the notebook or binder.

When the binder is full or near capacity, the covers are spaced apart and generally parallel to one another. In such a state, the notebooks can be stacked upon one another or placed on shelves where they will remain upright.

However, when the notebooks are empty or at less than capacity, the covers are pivoted towards one another, sometimes even touching one another at a leading edge thereof. This can create problems when stacking notebooks upon one another and when placing them on shelves as they have a more triangular configuration instead of a rectangular configuration in this state. This can oftentimes cause the binders to tip over and fall when placed upright on a shelf. Such a triangular configuration also creates problems when attempting to stack the binders upon one another.

Accordingly, there is a need for an apparatus which selectively squares the notebook or binder by positioning and supporting the covers in a generally parallel state so that the notebooks can be stacked upon one another and placed upon a shelf and remain upright. The present invention fulfills these needs and provides other related advantages.

SUMMARY OF THE INVENTION

The present invention resides in an apparatus for squaring or bracing the open end of a notebook or binder so that it stays upright when placed on a shelf and properly stacked when at less than capacity or empty. This is accomplished through provision of an apparatus selectively connected to the covers of the notebook or binder which securely holds the covers in a generally parallel spaced arrangement.

More specifically, present invention resides in an apparatus for squaring the covers of a notebook or binder comprising a brace having a first section attached to an inner surface of a first cover, a second section pivotally attached to the first section, and a third section pivotally attached to the second section opposite the first section. An adhesive strip may be utilized for adhering the first section to the first cover, if desired.

A connector is attached to an inner surface of the second cover of the notebook or binder. If desired, an adhesive may be utilized for adhering the connector to the second cover.

Connection means are provided for detachably connecting the third section of the brace to the connector. The connection means may comprise a hook and loop fastener, a magnet and/or a snap.

Means are provided for retaining the brace in a folded and flat state adjacent to an inner surface of the first cover when the apparatus is not in use. The retaining means includes detachable connectors for detachably securing the first section of the brace to the second section of the brace. The retaining means may comprise a hook and loop fastener, a magnet and/or a snap.

A width dimension of the second section of the brace generally corresponds with a width dimension of a spine of the notebook or binder.

Other features and advantages of the present invention will become apparent from the following more detail description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

As shown in the accompanying drawings, the present invention is directed to a notebook or binder squaring apparatus 100 which when in use facilitates binders 10 staying upright on a shelf as well as being properly stacked upon one another. As will be explained more fully herein, the squaring apparatus 100 of the present invention can be selectively moved from an unfolded and in-use position, wherein the notebook or binder is squared, to a folded position when not in use.

Figure 1:
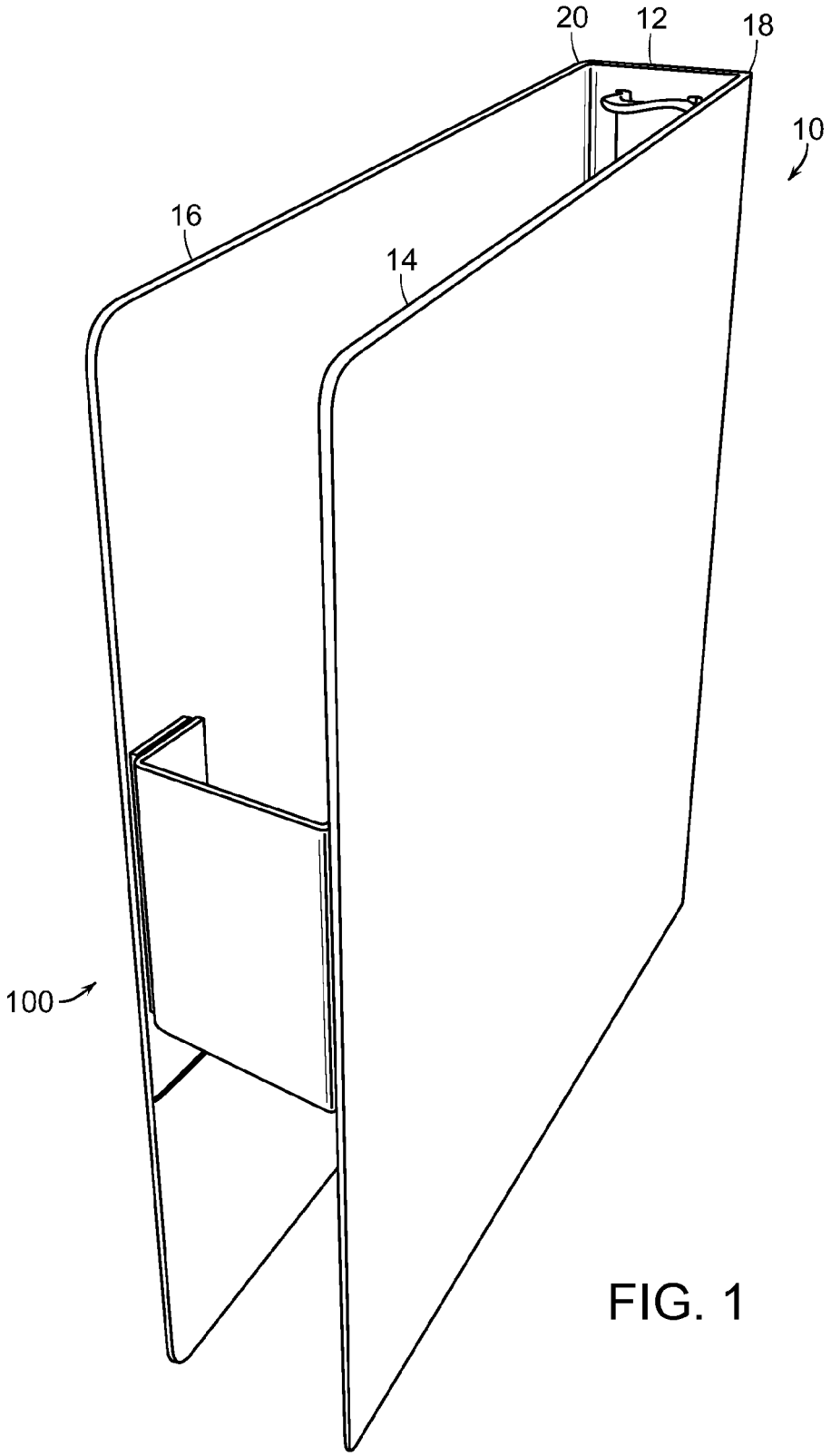
FIG. 1 is a front, side and top perspective view of a notebook or binder squaring apparatus of the present invention in a squaring position, in accordance with the present invention.
Figure 2:
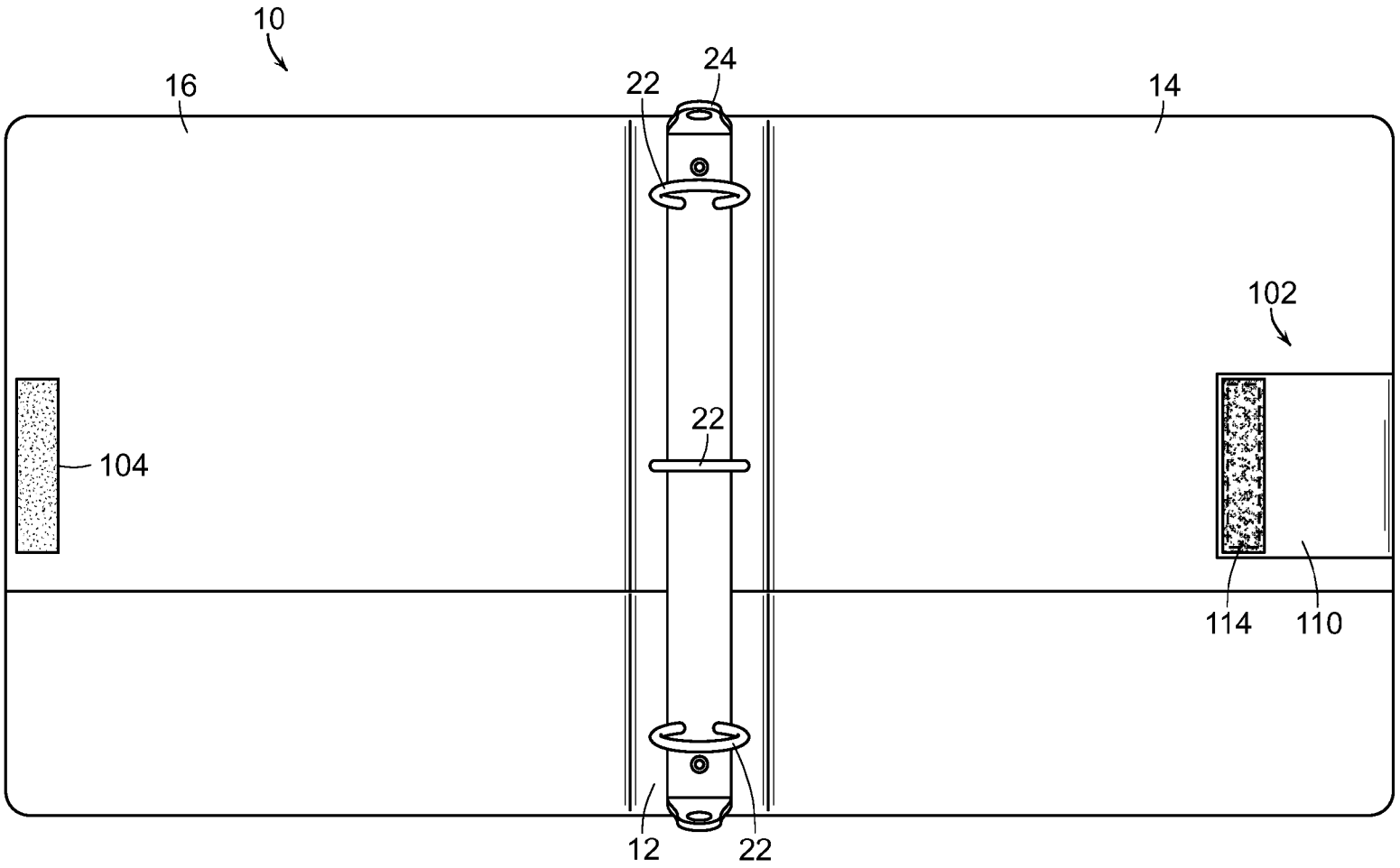
FIG. 2 is a front elevational view of an opened notebook, illustrating the squaring apparatus in a non-use and folded state.

With reference to FIGS. 1 and 2, the present invention is particularly suited for use in notebooks and binders 10 having a spine 12 of a given width and first and second covers 14 and 16 pivotally attached to the spine 12, such as by living hinges 18 and 20 which allow the covers 14 and 16 to be moved towards and away from one another.

With particular reference to FIG. 2, in the case of ringed binders, such as the illustrated 3-ring binder, a plurality of rings 22 are spaced from one another and can be opened by a mechanism 24 which can serve to open and unlock the rings 22 and close and lock the rings 22 in order to removably receive paper having holes punched therethrough, as is commonly known. Such binders are offered in a variety of sizes corresponding to either the size of the ring 22 and/or the width of the spine 12, which can range from a fraction of an inch, such as ½ inch, to several inches, such as 4 inches.

When the binder or notebook 10 is empty or at less than full capacity of the number of pages it can hold, the covers 14 and 16 are naturally brought towards one another, creating a generally triangular configuration. This triangular configuration does not adequately support the binder or notebook 10 when it is placed upright, often causing the binder or notebook to fall to one side when placed on a shelf. Moreover, attempting to stack multiple notebooks or binders on top of one another causes the upper-most binders or notebooks 10 to slide off of the stack due to the increasing angle that is created as the notebooks or binders are stacked upon one another.

Figure 3:
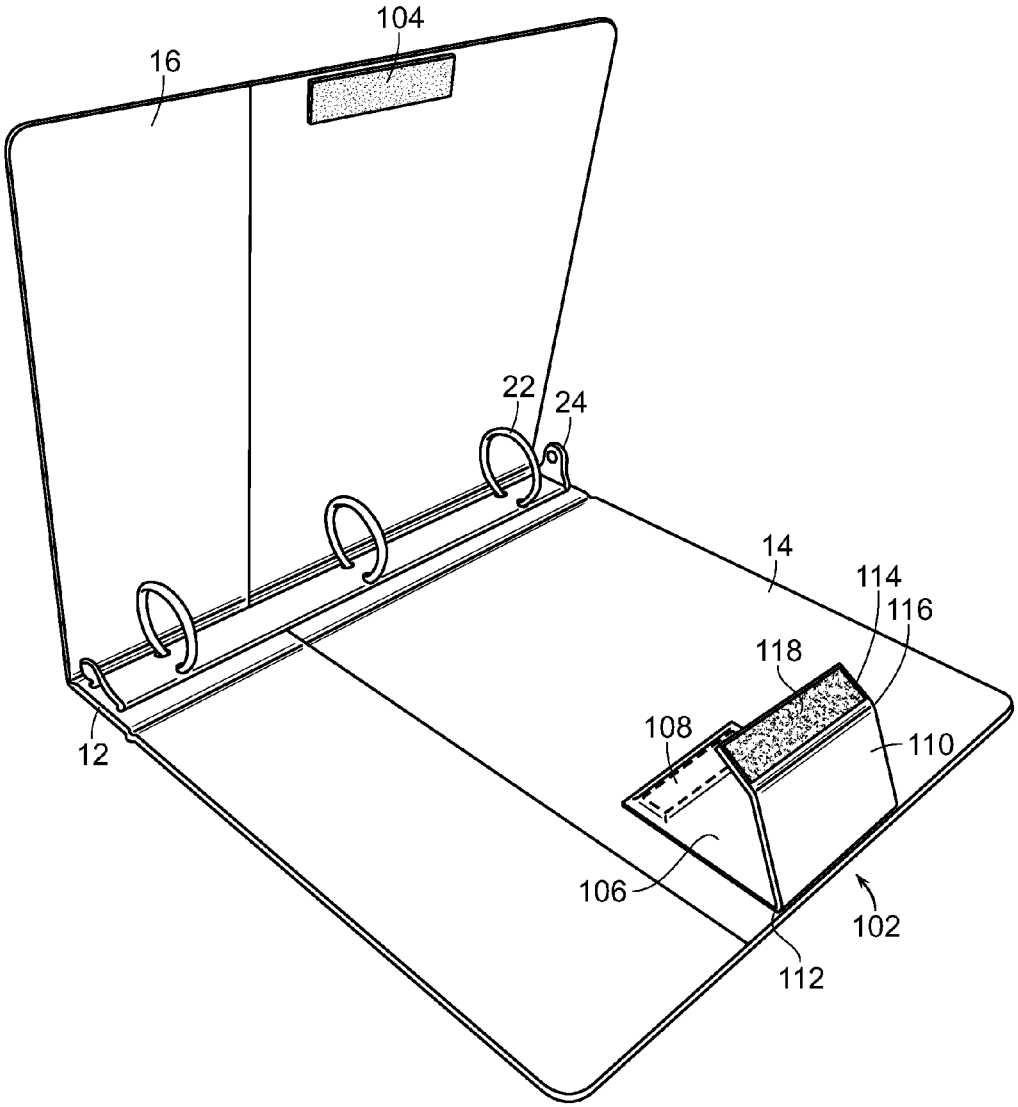
FIG. 3 is a perspective view of the notebook of FIGS. 1 and 2, illustrating the squaring apparatus and notebook covers being moved into an unfolded and squaring position.

In order to overcome these drawbacks, the present invention resides in an apparatus 100 which may be selectively used to brace and square the notebook such that the first and second covers 14 and 16 are spaced from one another to be generally parallel to one another, as illustrated in FIGS. 1 and 4-6. As shown in FIGS. 2 and 3, the squaring apparatus 100 is comprised of a brace 102 which is disposed on an inner surface of a notebook cover 14 and a connector 104 associated with a corresponding area of the other cover 16.

The brace 102 is comprised of a first section 106 which is attached to the inner surface of the first cover 14 of the notebook 100, such as by area 108 shown in the dashed lines, which could represent adhesive, stitching, fasteners, or even being formed integrally with the inner cover 14.

A second section 110 is pivotally attached to the first section 106, such as by a fold or a living hinge 112 formed between the two sections 106 and 110. The second section 110 has a width or dimension which can adequately square the first and second covers 14 and 16 relative to one another. The width or dimension of the second section 110 may correspond to the width or dimension of the spine 12 and/or rings 22.

A third section 114 is pivotally attached to the second section 110, such as by means of a fold or a living hinge 116 so that it can be selectively pivoted from a generally aligned position with respect to the second section 110, as illustrated in FIG. 2, to an angular position with respect to the second section 110, as illustrated in FIG. 3. The third section 114 includes connection means 118 for being detachably connected to the connector 104. The connection means 118 may comprise any connection which can be selectively connected coupled and uncoupled, including hook and loop fastener material, magnets, snaps, etc.

When not in use, as illustrated in FIG. 2, the second and third sections 110 and 114 of the brace 102 are generally folded and lie flat on the inner surface of the first cover 14. Preferably, means are provided for retaining the brace 102 in a folded and generally flat state when not in use, which can include magnets, hook and loop fasteners, or other releasable retaining and attaching means. The first and second covers 14 and 16 of the notebook or binder 10 can be freely pivoted toward and away from one another without any connection between the brace portion 102 and the connector portion 104 of the apparatus 100 of the present invention.

Figure 4:
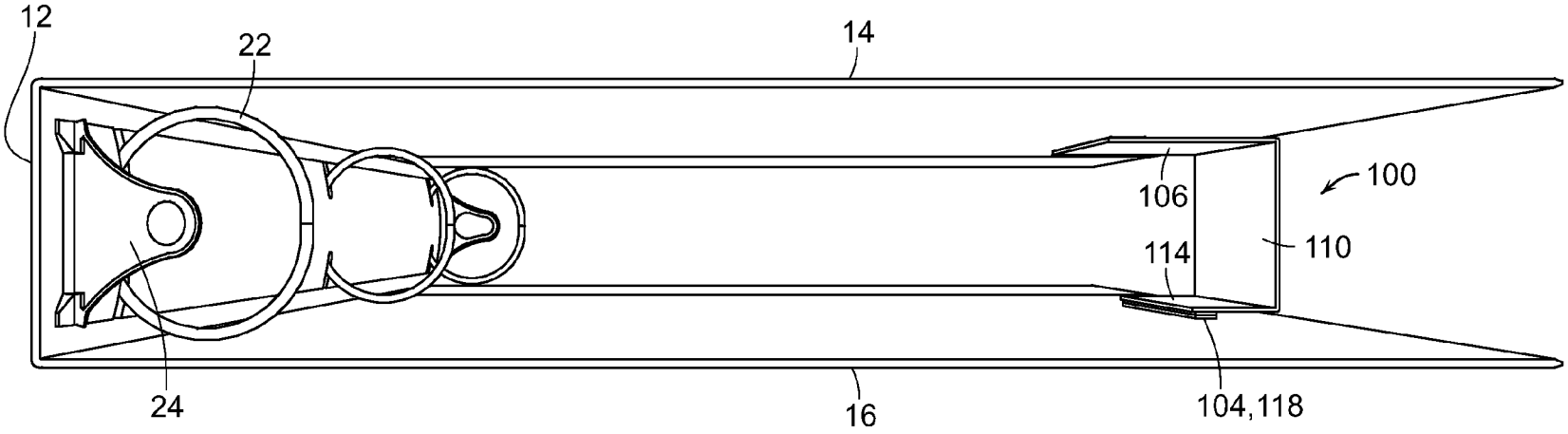
FIG. 4 is a bottom view of the notebook, illustrating the squaring apparatus in an unfolded state and squaring the notebook in accordance with the present invention.
Figure 5:
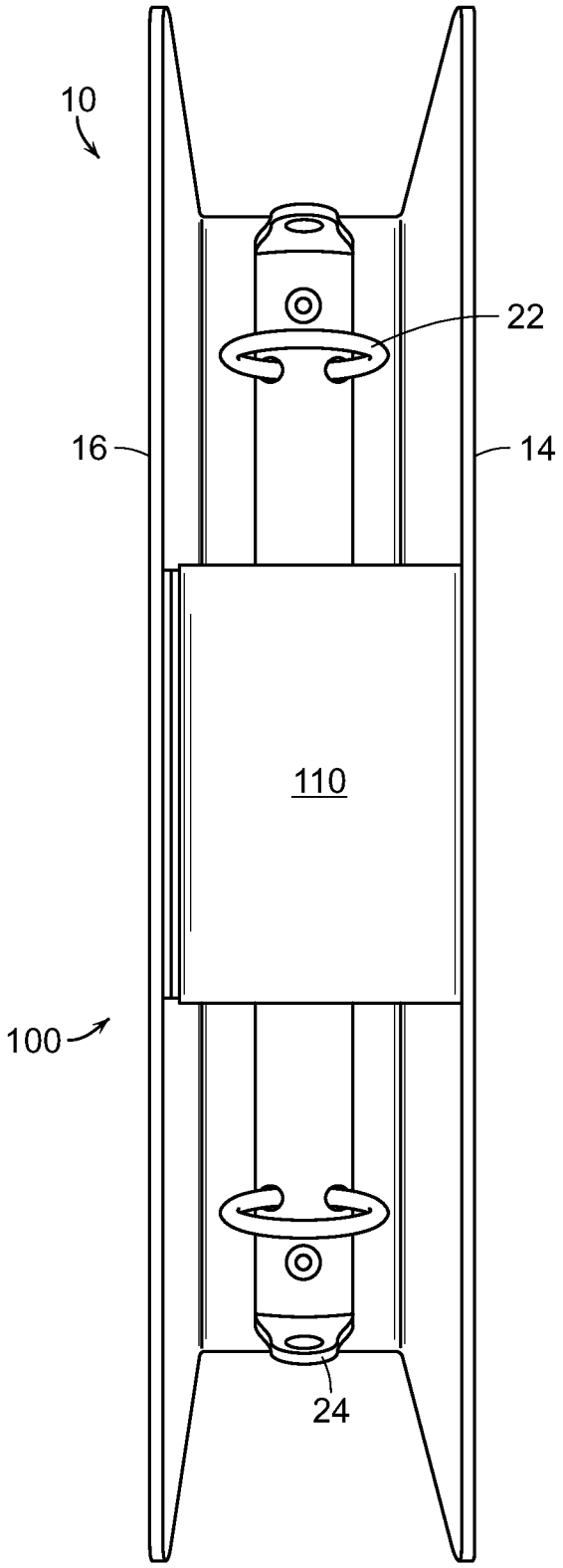
FIG. 5 is a front view of the notebook of FIG. 4, illustrating the squaring apparatus in a squared state.

However, as illustrated in FIGS. 3-5, when it is desired to brace and square the notebook or binder 100 such that the first and second covers 14 and 16 are disposed in spaced relation, such as being generally parallel to one another, the second section 110 of the brace 102 is pivoted upwardly and outwardly away from the first section 106, as illustrated in FIG. 3. The third section 114 is pivoted and moved until it is approximately at a right angle with respect to the second section 110, whereupon the connector 104 can come into contact with the connecting means 118 of the third section 114 and be detachably fastened thereto, as illustrated in FIG. 4.

Figure 6:
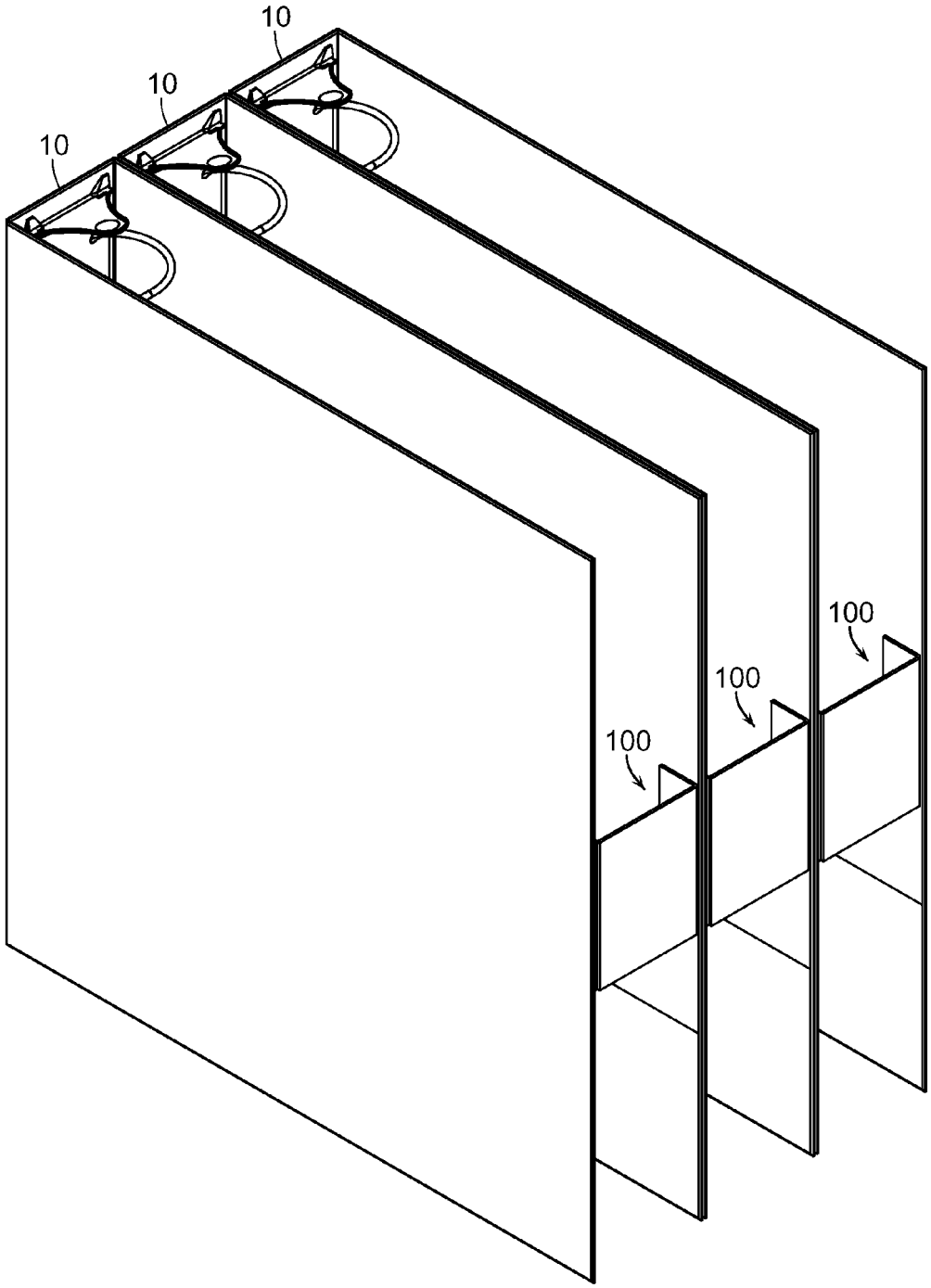
FIG. 6 is a perspective view of multiple notebooks, each having the squaring apparatus of the present invention.

This results in the binder or notebook 10 being made generally square in configuration with the first and second covers 14 and 16 spaced apart and generally parallel to one another. The width or dimension of the second section 110 of the brace portion 102 substantially determines the spacing between the first and second covers 14 and 16, which should be sufficient so as to enable the notebook or binder 10 to be self-supporting when placed upright on a shelf or other flat surface. This enables multiple binders or notebooks 10 to be placed on a shelf or other flat surface adjacent to one another and remain upright, as illustrated in FIG. 6. It will also be appreciated that if the notebooks or binders 10 were stacked upon one another, they would remain properly stacked upon one another as the notebooks or binders 10 had been substantially made square.

The squaring apparatus 100 of the present invention can be formed integrally or at the same time the notebook is manufactured. Alternatively, the apparatus 100 may be offered separately from the notebook and attached to existing notebooks, as an after-market product. Such is shown in FIGS. 7-11.

Figure 7:
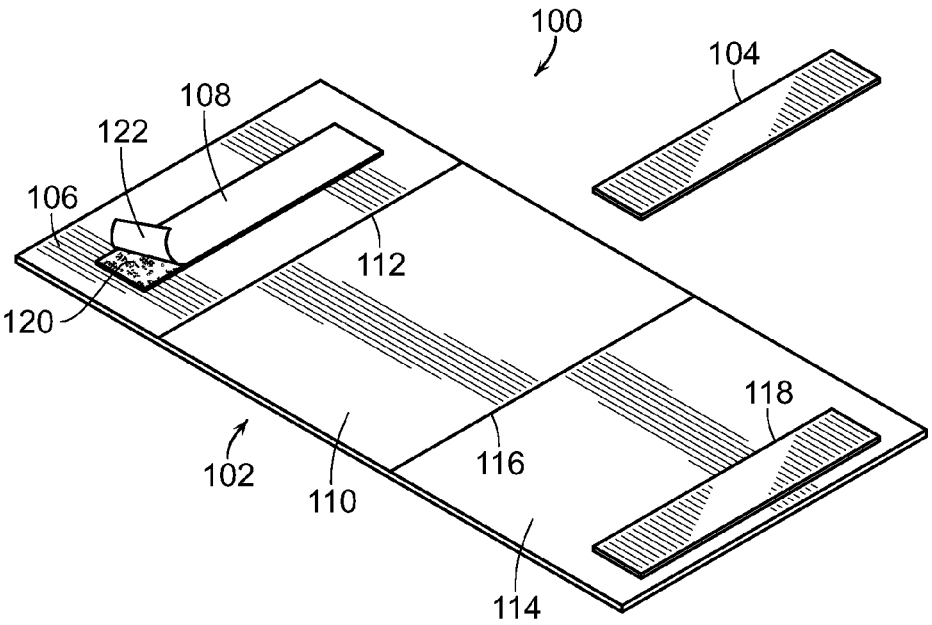
FIG. 7 is a perspective view of components of the squaring apparatus of the present invention.
Figure 8:
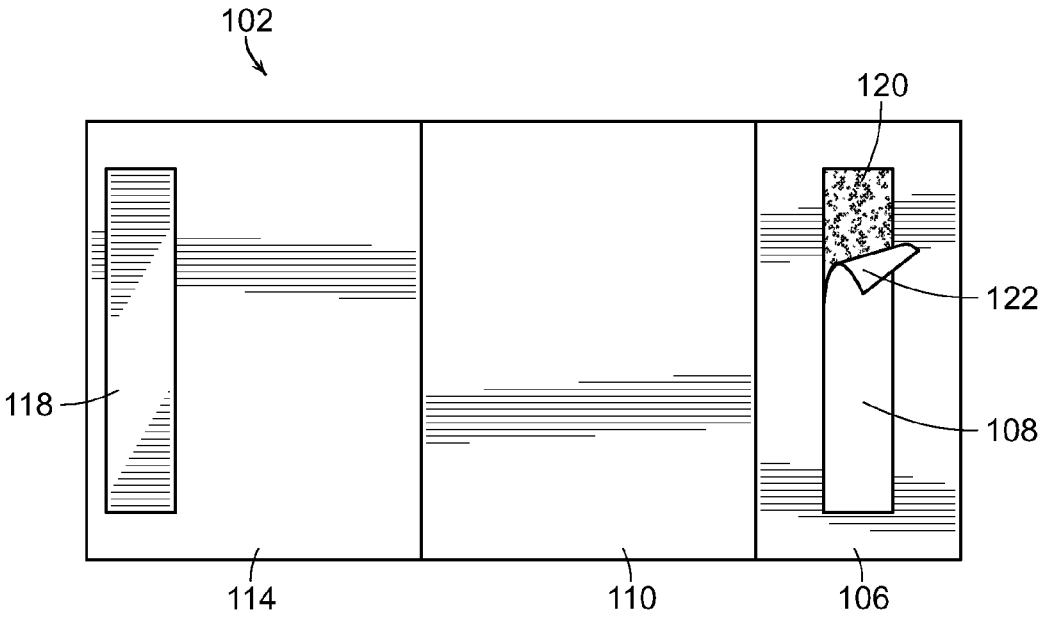
FIG. 8 is a top plan view of a hinged brace of the squaring apparatus of FIG. 7 in a fully open state.
Figure 9:
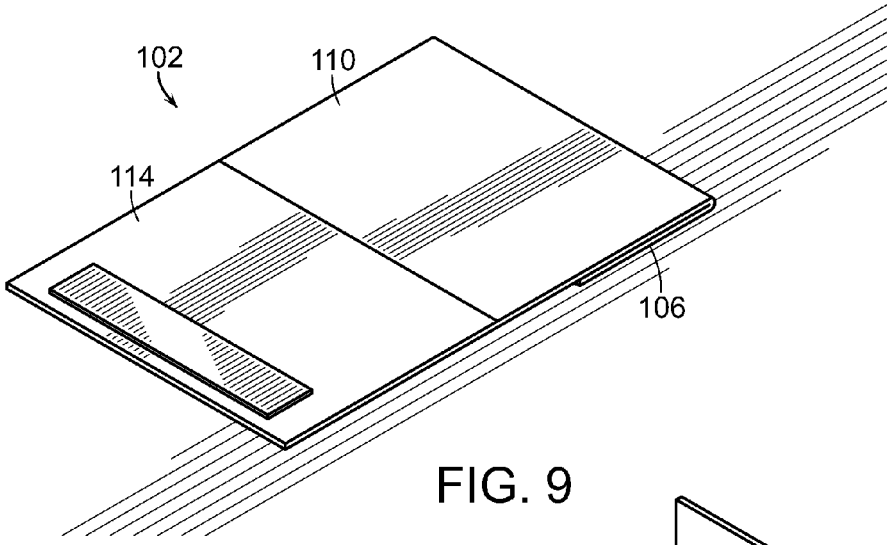
FIG. 9 is a perspective view of the hinged brace of the squaring apparatus of FIGS. 7 and 8 in a folded state.
Figure 10:
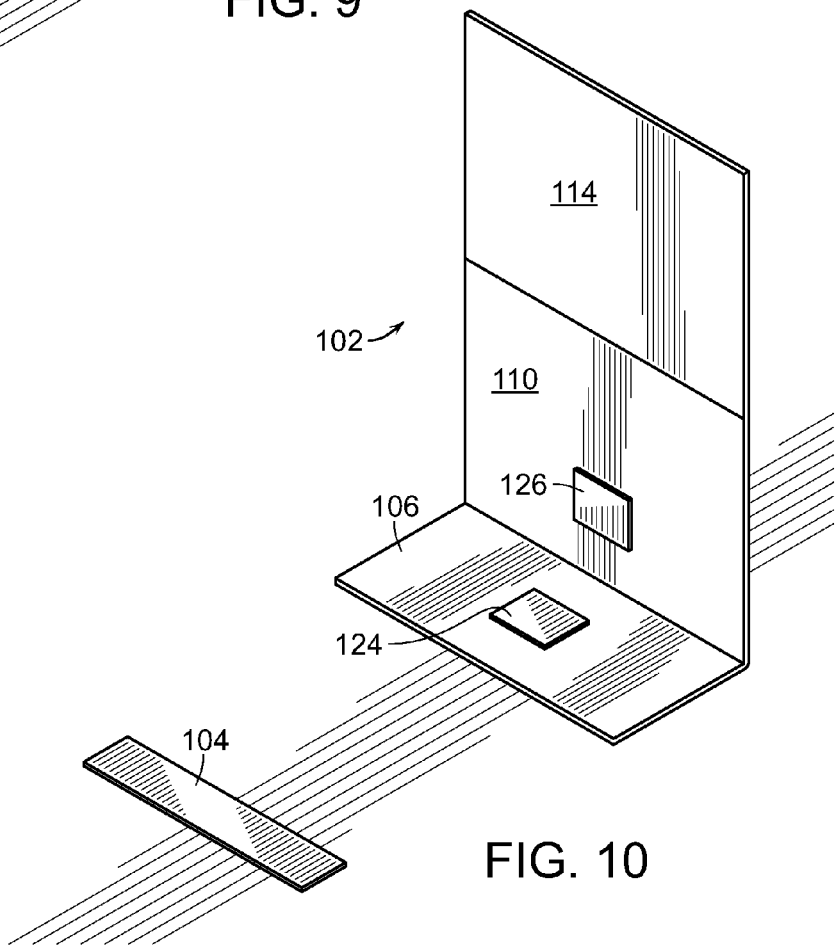
FIG. 10 is a perspective view similar to FIG. 9, illustrating the unfolding of the brace and a connector to be attached thereto.
Figure 11:
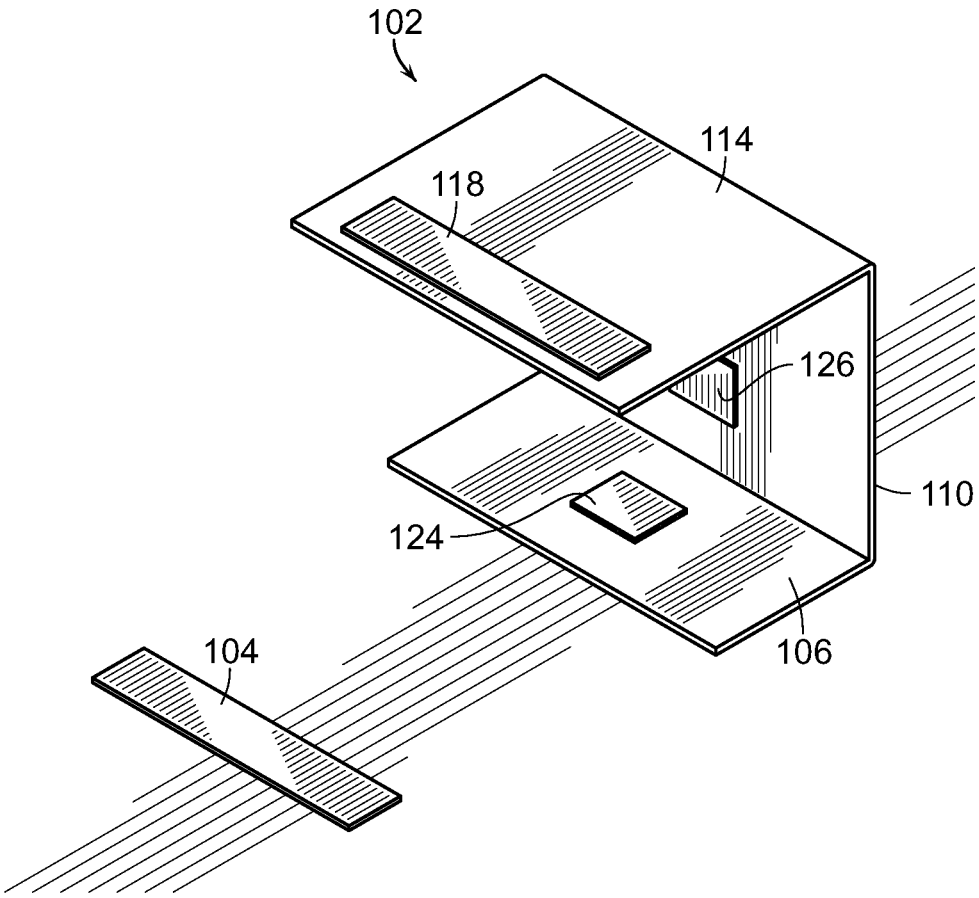
FIG. 11 is a perspective view similar to FIGS. 9 and 10, illustrating the folding of the brace into a squared position and ready to be removably connected to the connector of the squaring apparatus, in accordance with the present invention.

FIG. 7 illustrates the brace 102 having the first, second, and third sections 106, 110 and 114 separated by folds or hinges 112 and 116 so as to be pivoted with respect to one another. Attachment means 108 such as a strip of adhesive 120 exposable by a detachable, peel-away strip 122 is associated with the first section 106, and which would be attached to an inner surface of one of the covers 14 or 16 of the notebook 10. FIG. 9 illustrates the brace 102 in a folded state when not in use. FIGS. 10 and 11 illustrate the brace being unfolded and moved into a generally squaring position wherein the connector means 118 of the third section 114 can be detachably connected to the connector 104, which will be disposed on an inner surface of the opposite cover 14 or 16 of the notebook 10.

The connector 104 can be attached to the inner surface of the opposite cover 14 or 16 by any known means, but typically by adhesive. For example, the connector 104 may comprise either hook or loop tape having an adhesive backing protected by a peel-away strip. The peel-away strip is removed and the backing attached to an inner surface of a cover 14 or 16 which is generally aligned with the position where the unfolded connection means 118 of the brace portion 102 will be situated. This could be easily done, for example, by attaching the connector 104 to the connection means 118 and unfolding the brace portion 102 into a squaring position so that the position on the inner surface of the opposite cover 14 or 16 is perfectly aligned and known. Then, the connector 104 can be attached to that position on the inner surface of the opposite cover 14 or 16. Once again, the connector 104 and connecting means 118 can be any detachable connecting means or fasteners, such as magnets, hook and loop tape, etc.

With reference to FIGS. 10 and 11, detachable coupling means, such as magnets, hook and loop tape fasteners, or the like 124 and 126 are disposed on sections 106 and 110 of the brace portion 102 in such a manner that as the brace 102 is folded so as to generally lie flat when not in use, as illustrated in FIG. 9, the coupling means will retain the brace portion 102 in a generally flat and folded state. However, when the brace portion 102 is to be unfolded during use and moved into the squaring position, section 110 is easily detached from section 106. Other arrangements and means of retaining the brace portion 102 in a folded and generally flat state are also contemplated by the present invention.

Although several embodiments have been described in detail for purposes of illustration, various modifications may be made without departing from the scope and spirit of the invention. Accordingly, the invention is not to be limited, except by the following claims.

What is claimed is:

1. A binder, comprising: a first cover, a second cover, and a spine;

a brace having a first section attached to an inner surface of the first cover, a second section pivotally attached to the first section, and a third section pivotally attached to the second section opposite the first section;

a connector attached to an inner surface of the second cover;

connection means for detachably connecting the third section of the brace to the connector; and retaining means for retaining the brace in a folded and flat state on the inner surface of the first cover.

2. The apparatus of claim 1, wherein the retaining means includes detachable connectors for detachably securing the first section of the brace to the second section of the brace.

3. The apparatus of claim 2, wherein the retaining means comprises a hook and loop fastener, a magnet and/or a snap.

4. The apparatus of claim 1, wherein the connection means comprises a hook and loop fastener, a magnet and/or a snap.

5. The apparatus of claim 1, wherein a width dimension of the second section of the brace generally corresponds with a width dimension of the spine of the notebook or binder.

6. The apparatus of claim 1, wherein the first section is non-removably attached to the inner surface of the first cover, including an adhesive strip for adhering the connector to the second cover.

7. The apparatus of claim 1, including an adhesive strip for adhering the connector to the second cover.

8. A binder, comprising: a first cover, a second cover, and a spine;

a brace having a first section attached to an inner surface of the first cover, a second section pivotally attached to the first section, and a third section pivotally attached to the second section opposite the first section, wherein an adhesive strip adheres the first section to the first cover;

a connector attached to an inner surface of the second cover, wherein an adhesive adheres the connector to the second cover;

connection means for detachably connecting the third section of the brace to the connector, wherein the connection means comprises a hook and loop fastener, a magnet and/or a snap; and retaining means for retaining the brace in a folded and flat state on the inner surface of the first cover, wherein the retaining means includes detachable connectors for detachably securing the first section of the brace to the second section of the brace.

9. The apparatus of claim 8, wherein a width dimension of the second section of the brace generally corresponds with a width dimension of the spine of the notebook or binder.

10. The apparatus of claim 8, wherein the retaining means comprises a hook and loop fastener, a magnet and/or a snap.

* * * * *